US005823375A

United States Patent [19]

Nessfield

[11] Patent Number: 5,823,375

[45] Date of Patent: Oct. 20, 1998

[54] CARGO CONTAINER

[75] Inventor: Stanley Nessfield, Bainton, Great Britain

[73] Assignee: Sea Containers Ltd., London, United Kingdom

[21] Appl. No.: 901,197

[22] Filed: Jul. 28, 1997

[30] Foreign Application Priority Data

Aug. 1, 1996 [GB] United Kingdom ..... 9616146

[51] Int. Cl.[6] ..... B65D 90/62

[52] U.S. Cl. ..... 220/1.5; 206/512

[58] Field of Search ..... 220/1.5, 212; 206/512, 206/511, 509

[56] References Cited

U.S. PATENT DOCUMENTS

| | | | |
|---|---|---|---|
| 3,032,227 | 5/1962 | Guralnick et al. | 220/1.5 |
| 3,684,122 | 8/1972 | Bonomi | 220/1.5 |
| 4,057,170 | 11/1977 | Dougherty | 220/1.5 |
| 4,214,669 | 7/1980 | McQuiston | 220/1.5 |
| 4,653,659 | 3/1987 | Bersani | 220/1.5 |
| 4,998,634 | 3/1991 | Nessfield | 220/1.5 |

FOREIGN PATENT DOCUMENTS

| | | | |
|---|---|---|---|
| 4039836 | 6/1992 | Germany | 206/512 |

*Primary Examiner*—Stephen J. Castellano
*Attorney, Agent, or Firm*—Ladas & Parry

[57] ABSTRACT

A cargo container has a frame (3) and a door (8,9) mounted on the frame. A support, preferably in the form of stacking plate (30), is mounted on the door so that when the door is closed and excessive loads applied externally to the container distort the container frame, the support (30) mounted on the door (8.9) engages the frame (3). The support and the door thereby together share the loading forces of the external load with the container frame. Conveniently, the support is spaced from an ISO lifting casting (26) constituting part of the frame (3) of a container, when there are no external loading forces applied to the container frame. Preferably, part of the support is provided by one (19) of two side members (19,20) of the door arranged to extend in a direction between upper and lower crossmembers of the container, in use.

15 Claims, 2 Drawing Sheets

CARGO CONTAINER

This invention relates to a cargo container.

It is well known in the cargo container art that for convenience of loading a container and strength of mounting, doors for the container are located and form a rear wall surface of the container in use. The cargo container itself is constructed of a rectangular framework supporting a top, bottom, side walls, and a front wall, and the doors are pivotally mounted on elongate posts located at each corner at the rear of the container to define part of the rear wall. The two opposed rear corner posts extend in a vertical direction and are provided at each of the opposed ends thereof, respectively, with a standard ISO corner casting for attaching the container to lifting equipment or for stacking the container relative to other containers one upon the other, for example when stacked in the cell guides provided onboard ship, where as many as nine such cargo containers can be stacked one upon the other.

It is usual with such cargo containers to load them with pallets containing the articles to be transported. Accordingly, the pallets are constructed to standard sizes so that two pallets fit side by side in rows across the width of the container. However, difficulty is experienced when inserting the last row of pallets immediately in front of the door opening because the width of the door post across the rear wall of the container has the effect of providing a smaller opening width at the entry to the container than inside the container. Accordingly, the need to widen the opening in the region of the doors is acknowledged and some attempts have been made to overcome this problem by reducing the cross-sectional area of the door post in a direction transverse to the longitudinal axis of the corner posts.

Although the reduction in cross-sectional area of the corner posts has lead to an increased opening in the region of the doors which has helped considerably in the loading of the container, such containers have been further developed so as to increase further the internal dimensional width and length of the container so that larger pallets can be inserted into the container.

Consequently, even larger internal dimensions of the container openings have been sought and this has been achieved to some extent by further reducing the crosssectional area of the corner posts. Further improvement has been achieved by the manner in which the doors are mounted so that when moving into an open position the doors are swung completely outside the door frame opening as defined between the top rail, bottom rail and corner posts interconnecting the top and bottom rails. Nevertheless, the same problem exists in that the door frame opening of the container remains smaller than the internal width of the container.

Further reduction of the cross-sectional area of the corner posts has resulted in corner posts of much smaller cross-sectional area than hitherto known, such as an elongate plate having an L-shaped cross-section. Alternatively, the corner post can comprise a rectangular flat plate interconnecting the opposed top and bottom ISO standard connections which are welded to the corner posts along each of the opposed elongate spaced edges thereof, respectively, to firmly support the corner castings.

Whilst such a construction enables the maximum door opening, the strength of the construction at the corners of the container is considerably weakened and it has been found when stacking such containers that the corner castings have rotated about their interconnection with the corner post, resulting in a distortion of the ISO corner casting. When the cargo container is connected with lifting or transporting equipment, or other containers, the apertures of the corner castings may then not line up with the relevant lifting equipment etc. Each door has a seal around its outermost edge in the manner of Applicants' granted European (UK) Patent No. 0395640 and the distorted corner casting can have the disastrous effect of breaking the seal and allowing sea water, for example, to contaminate stored goods in the container.

It is an object of the present invention to substantially mitigate such problems.

According to the present invention there is provided a cargo container having a frame, a door mounted on the frame, and support means having a part thereof located between the door and container door frame so that when the door is closed and excessive loads are applied externally to distort the container frame, the support means engages the frame, so that the support means and the door together share loading forces of the external load with the container frame.

In one preferred embodiment according to the present invention the part of the support means is spaced from an ISO corner casting known per se constituting part of the frame of the container. Preferably, a part of the support means is provided by one of two side frames of a door of the container having cross-members extending therebetween, each side frame conveniently comprising an elongate hollow box section. The one side frame of the door is preferably that adjacent a hinge of the door.

Another part of the support means preferably comprises a stacking plate welded along the peripheral edge of the door to one end of the one side member of the door.

Preferably, the surface of the corner casting adjacent to and overlying the stacking plate preferably has a raised land, conveniently formed by weld material. The said spacing in this instance being between the land and the stacking plate in the closed position of the doors of the container. Conveniently, the spacing or gap is tapered rearwardly of the container, in use, towards the surface of the corner casting from which the raised land extends to aid closing of the door. The angle of taper is conveniently 8° but can be zero to 20° for example. Such taper further assists in opening the door.

In a further embodiment the raised land is omitted and the stacking plate is spaced from the corner casting by up to 1 mm.

Preferably, another embodiment requires the stacking plate to have a tapered cross-section in a plane transverse to the longitudinal axis of the elongate side frame support of the door to accommodate an angled door seal located around the external peripheral edge surface of the door for sealing the door relative to the door frame of the container.

An embodiment of the present invention will now be described by way of example with reference to the accompanying drawings, in which.

Figure 1:
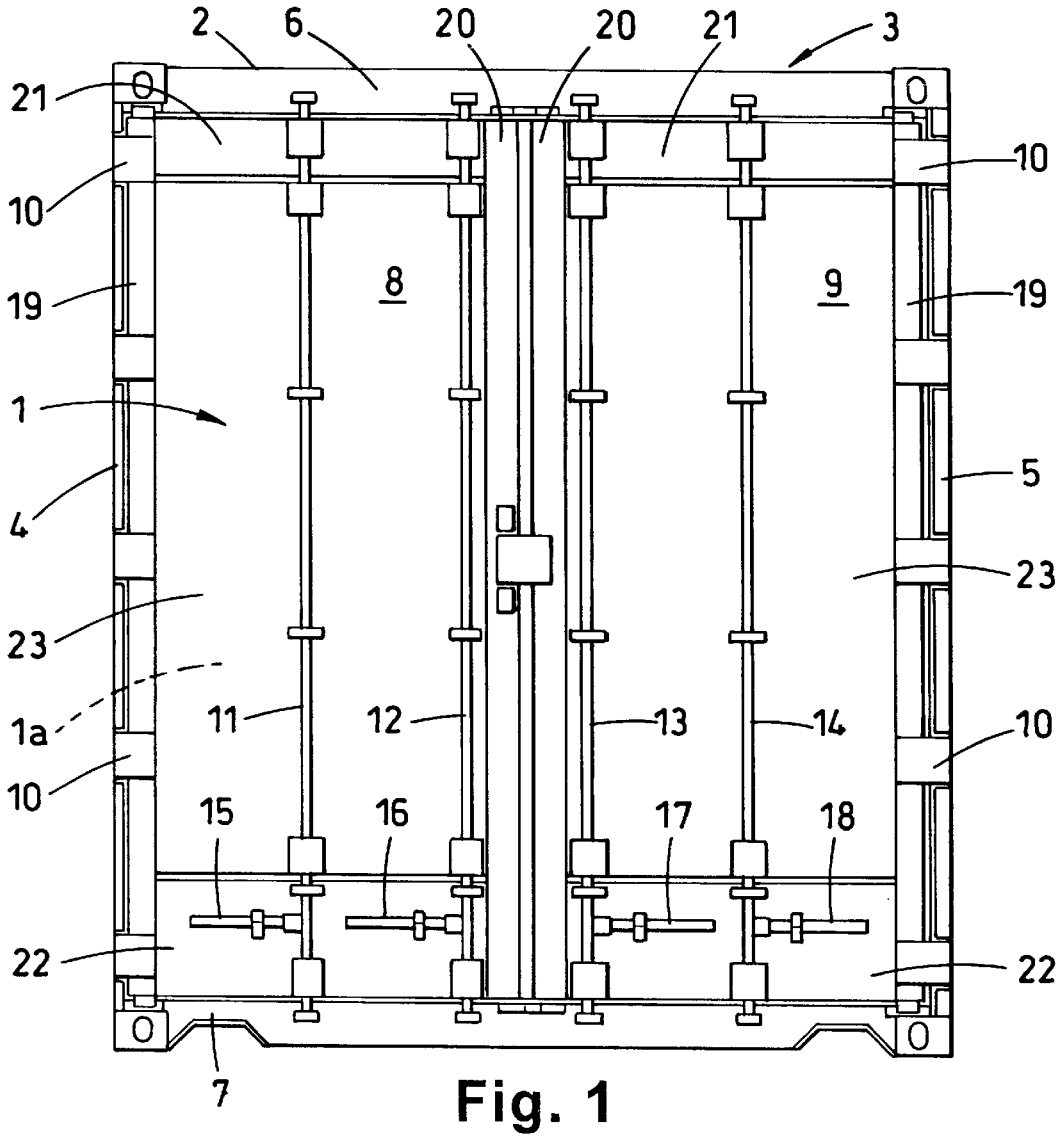
FIG. 1 is a rear elevational view of a container according to the present invention.

Referring specifically to the drawings, there is illustrated a rear end face 1 of a hollow rectangular box cargo container 2. The rear end face 1 comprises a rectangular frame 3 having opposed vertically extending support rails 4 and 5 spaced apart by top rail 6 and a bottom rail 7 to define a rectangular opening 1*a* in the rear face of the container through which cargo can be loaded into the inside of the container.

The container 2 is closable by two doors 8, 9 pivotally mounted via hinges 10 on the vertical side rails 4 and 5, respectively. Locking rods 11, 12, 13 and 14 extend in a vertical direction in FIG. 1. Two of the locking rods are located on each door to lie within the profile of the door and are each operable separately by handles 15, 16, 17 and 18, respectively, to open or lock the door relative to the top 6 and bottom rail 7, respectively. The doors, when pivoted open on the hinges illustrated do not obstruct the opening provided by the frame members 4,5,6 and 7 of the container which themselves define the opening for the container.

Each door 8, 9 is defined by two elongate side frame members 19, 20 which are each of a hollow rectangular box cross-section, and are interconnected by top and bottom plates 21, 22 and a central plate 23.

It is usual in the container art for a top transverse peripheral edge surface 24 of the door to be spaced from under surface 25 of ISO corner casting 26 by a gap 27 of for example, 44 mm.

Although Applicant's invention is disclosed in FIG. 1 the more detailed drawings of FIGS. 2 to 5 illustrate Applicant's invention more clearly. In these Figures a stacking plate or support block 30 is mounted on the top peripheral edge surface 24 of one door 9 and in the region of the hollow section side member 19 of the door. Stacking plate 30 extends in the elongate direction of the door side member 19 to substantially fill the gap 27 between the top peripheral edge surface 24 of the door and the under surface 25, FIG. 2 of the corner casting 26 overlying the peripheral edge surface 24 of the door.

In the embodiment, as mentioned above, the gap 27 between the surfaces 24 and 25 is approximately 40 mm with the height of the stacking plate 30 being approximately 35 mm. A raised land 31 comprises a wedge plate welded on the surface 25 of the corner casting so that the sloping surface of the wedge prevents the stacking plate 30 otherwise engaging the raised land, side surface to side face, to prevent closing the door and provides a smooth mating surface with the stacking plate 30. Such plate is approximately 3.5 mm to 4 mm thick in the axial direction of the door side frame member 19, leaving a gap 28 up to 1 to 1.5mm between the stacking plate 30 and the raised land 31.

Figure 3:
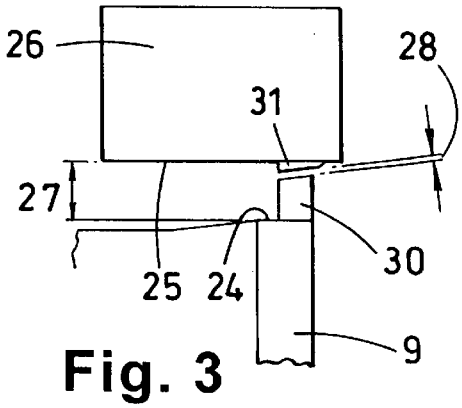
FIG. 3 is a partial elevational view in the direction of arrow C of FIG. 2.

Referring to FIG. 3, the gap 28 between the stacking plate 30 and the land 31 is arranged at an angle relative to the surface 25 of the corner casting 20 for assisting in opening and closing the door 9. The angle of the surfaces defining the gap 28 is advantageously set at 8° relative to the surface 25.

Figure 2:
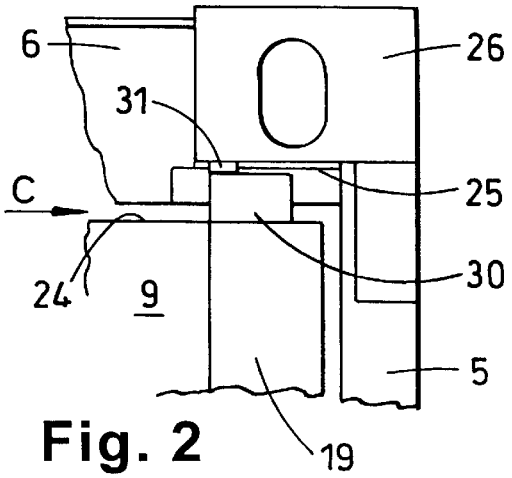
FIG. 2 is a partial rear elevational view illustrating the inter-relationship between a top right hand corner of a door and a top right hand corner casting of the container.
Figure 4:
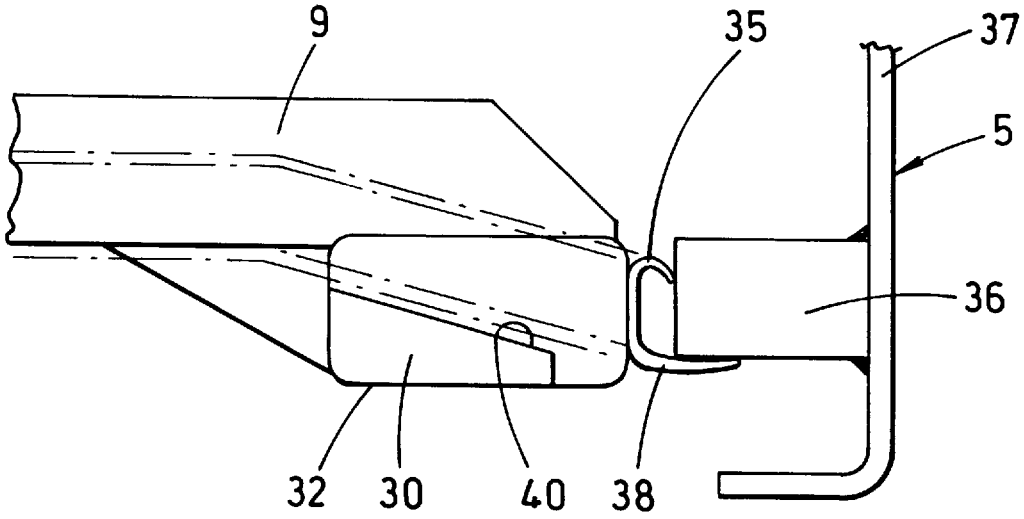
FIG. 4 is a partial top view illustrating the door, a corner post and the positioning of the door seal.

The stacking block 30 is shown in FIGS. 2 to 4 to be of a rectangular configuration when viewed from the outside of the container but as seen particularly in FIG. 4 the stacking plate 30 tapers towards outermost edge surface 32 of the door 9. The purpose of such taper is to accommodate door seal 35 which extends around the whole of the external peripheral edge surface of the door. As shown in FIG. 4 the seal is effective to seal the door against the container frame, such as the corner post 5 which comprises the combination of an elongate solid bar 36 against which the door seal 35 engages, and a thin angle plate 37 which is welded to the bar 36 to provide additional strength to the corner post 36. The seal extends across the top of the door as illustrated in broken lines in FIG. 4.

The relative height of the stacking plate 30 in the elongate axial direction of the side frame 19 of the door 9 is chosen to ensure that the stacking plate is much higher than the length of the longer arm 38 of the seal 35 so that when the seal passes along the top peripheral edge surface of the door 9 the seal does not become entrapped between the top surface of the stacking plate 30 and the land 31.

Figure 5:
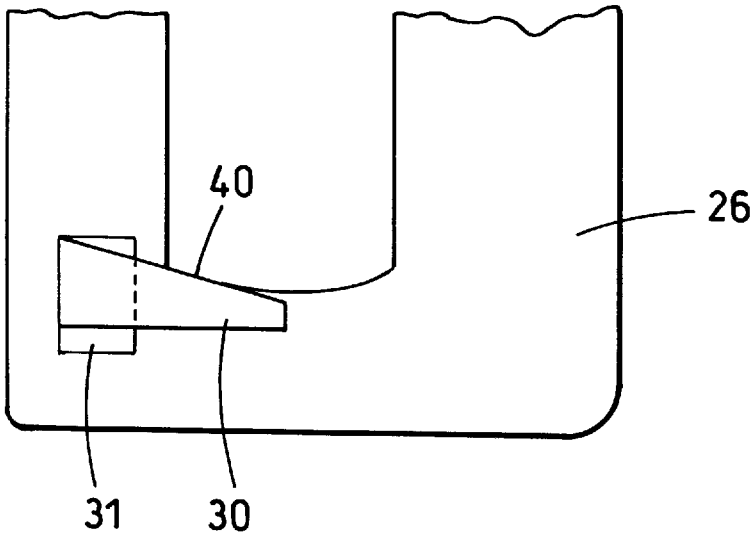
FIG. 5 is a partial top view of one corner casting illustrating the relative positions of stacking plates and land located on the door and casting respectively.

FIG. 5 again shows the stacking plate 30 to be advantageously located so that tapered surface 40 of the stacking plate clears the seal 35. The land 31 is also illustrated in FIG. 5 to show the relative positioning between the land 31 and the stacking plate 30 in the closed position of the door.

Although only the right hand top corner casting 20 and right hand top edge of the door 9 has been described, such a construction is to be found at each of the other three corner casting and hinged door corners in FIG. 1, in an identical manner, as appropriate, in their respective orientations, thereby providing on each side of the container a continuous additional column for assisting in stacking containers.

The operation of Applicant's invention is best understood when the doors of the container are shut, as illustrated in FIG. 1. When a container is loaded onboard a ship, whether the container be loaded or empty, it is often the case that excessive loads are applied to the corner castings 26. The castings are used to assist in guiding the container in cell guides onboard ship, for example. The containers are otherwise free standing with other containers stacked immediately one upon the next in the cell guide. Up to eight other containers can be stacked upon Applicant's container. Because the corner castings 25 are welded to the corner post 36 and plates 37 over only part of the surface 25 of the corner casting there is a tendency for an innermost edge 39 of the corner casting to pivot inwardly of the container.

Without Applicant's invention the distortion of the corner castings can be so severe as to make the containers unusable because of difficulties in attaching transporting equipment to the container through the standard fixing of the ISO corner casting. However, in using the stacking plate 30 of Applicant's invention in the present embodiment any drop in the corner casting will result in the land 31 engaging with the opposed surface of the plate 30, thereby allowing rotation of the corner casting 25 by no more than the thickness of the gap 28 which would normally be present between the plate and land 31. This gap is up to 1.5 mm. The land 31 has a relatively small contact area with the plate 30 but the forces which are brought to bear upon the plate 30 are spread over a larger area in view of the greater width of the plate 30 in a direction across the rear surface of the container between corner posts 4 and 5. The forces in the plate 30 are transferred to the side frame member 19 of the door, thus effectively acting as an additional support to that provided by the corner post.

To reiterate, the left hand top corner casting as shown in FIG. 1 is similarly constructed to the right hand corner casting as described above and operates in an identical manner to that of the post 19 of door 9.

Although the above referenced embodiment has been described using a stacking plate 30 and a land 31, it is possible to modify the construction to omit the land 31 and to extend the plate 30 in the longitudinal axial direction of the hollow box section 19 so that it is spaced approx. 1 mm from the surface 25 of the corner casting. In such an instance any force upon the corner casting 26 will result in the surface 25 of the corner casting making direct contact with the opposed surface of the stacking plate 30, whereupon again all the forces on the corner castings will be transmitted through to the elongate box frame member 19 of each door to the bottom right hand corner casting.

In a further alternative embodiment the land 31 is a block of steel which is welded to the surface 25 of the corner casting. In the embodiments in which a land 31 is provided the angle in which the gap 28 between the land and the stacking plate extends is described as being 8° . However, such angle preferably lies in the range of 0 °–15 ° . Larger angles may be used, say up to 20° but as the angle increases beyond this value the efficiency of the downward pressure force onto the hollow elongate box side frame 19 is reduced and a sliding effect becomes more apparent between the land and the stacking place which in turn causes a greater angle of rotation of corner fittings with subsequent loss of use of the corner casting.

The invention has been disclosed with reference to the rear doors of a container. However, the invention as described can equally apply to doors located along the elongate side face of the container wherein the stacking plate 30 on the door co-operates directly, or via a land 31, with ISO castings on the top and bottom side rails, respectively. Alternatively, at least one of a pair of these side doors may be hinged between ISO castings located intermediate the ends of a container on the top and bottom side rails, respectively, the other of the pair of doors being hinged between top and bottom corner castings both being constructed in an identical manner to that described above with reference to the embodiment of FIGS. 1 to 5 and any variations of modifications thereof. For example, a 13.6 m (44 ft) long container may also have intermediate ISO castings at 12.2 m (40 ft) and at 6.06 m (20 ft) from one end of the container to support a container thereon of a lesser length and provide the necessary support therefore and to avoid buckling of the side rails. Castings may also be provided at 7.58 m (25 ft). Where the door opening is particularly wide each door may be split into two hingedly interconnected parts with the innermost door part between the ISO castings being provided with a stacking plate 30 for use as previously described herein. A land 31 may similarly be provided.

I claim:

1. A cargo container having a bottom, side walls and a top within a frame, the frame incorporating castings known per se for stacking one container upon another, a door mounted at least partially within the frame to define a peripheral gap between the frame and at least part of the door and support means located on at least one of the door and the frame partially to extend across the peripheral gap only in the vicinity of the castings when the container is not under an external load. wherein when the door is closed and a load is applied externally to the container to distort the frame, the support means engages an opposite side of the peripheral gap, so that the support means and door together share loading forces of the external load with the frame.

2. A container as claimed in claim 1, wherein the support means is spaced from a casting known per se which said casting constitutes part of the frame of the container.

3. A container as claimed in claim 2, wherein the external load is transmittable through one of two side frame members of the door arranged to extend substantially between an upper and a lower cross-member of the container, in use.

4. A container as claimed in claim 3, wherein the one side frame member of the door is that in which a hinge of the door is mounted.

5. A container as claimed in claim 3, wherein the support means comprises a stacking plate welded on a peripheral surface of the door in the region of one end of one of two side frame members of the door.

6. A container as claimed in claim 5, wherein the surface of the casting adjacent to and overlying the stacking plate has a raised land forming part of the support means.

7. A container as claimed in claim 6, wherein the raised land is formed by weld material.

8. A container as claimed in claim 7, wherein a tapered spacing, having a taper angle sloped inwardly of the container in use, is located between the raised land and the stacking plate in the closed position of the doors of the container.

9. A container as claimed in claim 8, wherein the taper angle is 0°–20°0 .

10. A container as claimed in claim 9, wherein the taper angle is 8°.

11. A container as claimed in claim 2, wherein the support means is spaced from the casting by up to 1 mm.

12. A container as claimed in claim 3, wherein the support means has a tapered cross-section in a plane transverse to the longitudinal axis of the side frame members of the door to accommodate an angled door seal located around an external peripheral edge surface of the door for sealing the door relative to the frame of the container.

13. A cargo container having a bottom, side walls and a top within a frame, the frame incorporating castings known per se for stacking one container upon another, a door mounted at least partially within the frame to define a peripheral gap between the frame and at least part of the door, and support means located on at least one of the door and the frame partially to extend across the peripheral gap only in the vicinity of the castings, such that a gap of between 1 mm and 1.5 mm is produced when the container is not under an external load, wherein when the door is closed and a load is applied externally to the container to distort the frame, the support means engages an opposite side of the peripheral gap, so that the support means and door together share loading forces of the external load with the frame.

14. A cargo container having a bottom, side walls and a top within a frame, the frame incorporating castings known per se for stacking one container upon another, a door mounted at least partially within the frame to define a peripheral gap between the frame and at least part of the door, and support means located on the door and the frame partially to extend across the peripheral gap only in the vicinity of the castings when the container is not under an external load, the support means located on one of the door or the frame being a land formed by weld material, wherein when the door is closed and a load is applied externally to the container to distort the frame, the support means engages an opposite side of the peripheral gap, so that the support means and door together share loading forces of the external load with the frame.

15. A cargo container having a bottom, side walls and a top within a frame, the frame incorporating castings known per se for stacking one container upon another, a door mounted at least partially within the frame to define a peripheral gap between the frame and at least part of the door, and support means located on at least one of the door and the frame partially to extend across the peripheral gap only in the vicinity of the castings, such that a remaining gap is produced in the vicinity of the casting when the container is not under an external load, said remaining gap being a tapered gap having a taper angle sloped inwardly of the container, wherein when the door is closed and a load is applied externally to the container to distort the frame, the support means engages an opposite side of the peripheral gap, so that the support means and door together share loading forces of the external load with the frame.

* * * * *